United States Patent [19]

Morimoto et al.

[11] Patent Number: 4,472,658

[45] Date of Patent: Sep. 18, 1984

[54] FLUORESCENT DISPLAY DEVICE

[75] Inventors: Kiyoshi Morimoto; Hiroshi Watanabe, both of Mobara, Japan

[73] Assignee: Futaba Denshi Kogyo Kabushiki Kaisha, Mobara, Japan

[21] Appl. No.: 261,130

[22] Filed: May 7, 1981

[30] Foreign Application Priority Data

May 13, 1980 [JP] Japan ..... 55-64504[U]
Jul. 17, 1980 [JP] Japan ..... 55-102610[U]

[51] Int. Cl.[3] ..... H01J 63/06; H01J 19/40
[52] U.S. Cl. ..... 313/497; 313/313
[58] Field of Search ..... 313/496, 497, 517, 519, 313/313

[56] References Cited

U.S. PATENT DOCUMENTS

| | | | |
|---|---|---|---|
| 3,201,634 | 8/1965 | Wiedel et al. | 313/497 |
| 3,532,921 | 10/1970 | Akabane et al. | 313/497 |
| 3,986,185 | 10/1976 | Bylander | 340/758 |
| 4,004,186 | 1/1977 | Bylander | 313/497 X |
| 4,047,072 | 9/1977 | Kishino et al. | 313/496 |
| 4,098,939 | 7/1978 | Kuroda et al. | 313/496 X |
| 4,122,376 | 10/1978 | Mera et al. | 313/496 X |
| 4,223,244 | 9/1980 | Kishino et al. | 313/497 |

FOREIGN PATENT DOCUMENTS

| | | | |
|---|---|---|---|
| 2328849 | 12/1973 | Fed. Rep. of Germany | 313/497 |
| 0146575 | 11/1979 | Japan | 313/496 |

*Primary Examiner*—Palmer C. Demeo
*Attorney, Agent, or Firm*—Oblon, Fisher, Spivak, McClelland & Maier

[57] ABSTRACT

A fluorescent display device of the type that the phosphorous luminous display is observed through an external surface of a transparent substrate. The internal surface of the anode sections composed of transparent conductive layers having phosphor layers deposited thereon. The device includes insulating layers deposited on the conductive films except the anode sections on which the phosphor layers are deposited so as to effect luminous display which is clear, distinct and free from display defects.

7 Claims, 11 Drawing Figures

FLUORESCENT DISPLAY DEVICE

BACKGROUND OF THE INVENTION

1. Field of the Invention

This invention relates to a fluorescent display device, and more particularly to such a type of fluorescent display device that luminous display can be observed through an external surface of a transparent substrate, the internal surface of which anode sections are formed.

2. Description of the Prior Arts

A fluorescent display device performs luminous display in the form of letters, figures and the like by selectively impinging electrons emitted from cathodes on anodes having phosphor layers deposited thereon. Such a fluorescent display device has several advantages when it is used. For instance, it is easy to observe its luminous color, and also it can be driven at a low voltage and is low in power consumption. Accordingly, the fluorescent display device has been extensively used in display portions of various electronic devices and instruments.

Conventional fluorescent display devices are generally divided into two types, namely, the type of observing luminous display of phosphor layers deposited on the upper surface of anode sections formed on an insulating substrate through grids, cathodes and a front glass and the type of observing the luminous display of the phosphor layers through a transparent substrate on which anode sections made of a transparent conductive film and coated with phosphor layers are formed.

In the conventional fluorescent display devices of the former type, electrode sections within the display tube are visible from the outside and the shoulder portions of a front glass cover obstruct the observation of luminous display, which results in reducing the visual field of luminous display. Such a disadvantage is further promoted by grids, because the grid holders obstruct the observation of luminous display and restrict the visual field. In the conventional fluorescent display device having a tetrode structure for effecting multi-digit dot-matrix display which includes a grid for selecting a row or column of dots and a grid for selecting a digit to be displayed, luminous permeability from phosphor layers is variable depending on viewing angle, because both the grids visually overlap each other. In the conventional fluorescent display devices using a filter for making grids and other elements invisible, the luminous brightness is significantly decreased.

The fluorescent display devices of the latter type is disadvantageous in that the contrast between the luminous and non-luminous portions is unsatisfactory and the resulting display is hard to observe because light emitted from phosphor layers in the direction opposite to the viewing direction of the display portion is reflected by grids, the inner surface of a front glass or the like disposed opposite to the phosphor layers and is dispersed through transparent electrodes and substrate.

BRIEF SUMMARY OF THE INVENTION

The present invention is intended to eliminate the above-mentioned disadvantages of the prior arts.

Accordingly, it is an object of the present invention to provide a fluorescent display device capable of performing phosphorous luminous display which is clear and distinct, and is observed through an external surface of a transparent insulating substrate having anode sections arranged on the internal surface thereof and insulating layers deposited on the entire surface of the substrate except the anode sections on which the phosphor layers are deposited.

It is another object of the present invention to provide a fluorescent display device capable of performing phosphorous luminous display which is excellent in luminous quality, clearness and brightness by using insulating layers of semitransparent or opaque material so as to improve the contrast of luminous display.

It is a further object of the present invention to provide a fluorescent display device capable of performing uniform luminous display which is free from irregular emission by using leads of higher electric conductivity for connecting each of transparent electrodes so that the voltage drop between the transparent electrodes may be compensated.

It is still a further object of the present invention to provide a fluorescent display device capable of performing phosphorous luminous display which is clear and free from display defects, and includes anode sections having phosphor layers deposited thereon which are of thickness less than insulating layers for increasing emission of light permeated through the phosphor layers and a control electrode extending to the portions of the insulating layers adjacent to the phosphor layers in the close or adjacent relationship to the insulating layers to prevent the negative charge of the insulating layers.

According to the present invention, there is provided a fluorescent display device comprising a transparent insulating substrate, transparent anode sections made of transparent conductive films applied on one surface of the substrate and deposited phosphor layers thereon, wiring means formed on the one surface of the substrate to apply display signal to the anode sections so that electrons emitted from cathodes impinge upon the anode sections to allow the phosphor layers to give force luminous emission of the predetermined shape, insulating layers deposited on the conductive films except the anode sections on which the phosphor layers are deposited, whereby the luminous display is observed through the other surface of the transparent substrate.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designates the same or similar parts throughout, wherein.

DETAILED DESCRIPTION OF THE PREFERRED EMBODIMENTS

A fluorescent display device according to the present invention will be hereinafter described with reference to the accompanying drawings.

Figure 1:
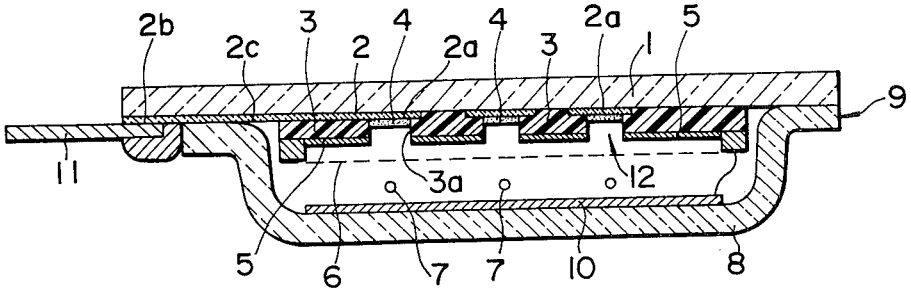
FIG. 1 is a longitudinal sectional view of a fluorescent display device according to a first embodiment of the present invention.

FIG. 1 is a longitudinal sectional view of a fluorescent display device according to a first embodiment of the present invention. The fluorescent display device shown in FIG. 1 includes a transparent substrate 1 formed of insulating material, such as, for example, glass or the like. The substrate 1 is provided on one surface thereof with wiring patterns made of transparent conductive films 2 which are divided into several fractions corresponding to predetermined number of segments of anode conductors 2*a*. The substrate 1 also has semitransparent or opaque insulating layers 3 deposited on the conductive films 2 except the portions acting as transparent electrodes 2*a* arranged in a segment shape. A thin phosphor layer 4 is deposited on each of the transparent electrodes 2*a* formed at concave areas 3*a* defined between each adjacent two insulating layers 3. The portions of the conductive films 2 covered with the insulating layers 3 are adapted to serve as leads 2*c* and extend to terminal connecting sections 2*b* of external terminals 11. Each of the insulating layers 3 is provided thereon with a conductive film 5 for preventing electric charges.

The fluorescent display device also includes a grid 6 and cathodes 7 disposed opposite to the surface of the substrate 1 having the phosphor layers 4, and the grid and cathodes are electrically connected through holes (not shown) of the insulating layers 3 to the predetermined transparent conductive films 2. The grid 6 and cathodes 7 are accomodated in an evacuated casing 9 airtightly formed by the substrate 1 and an envelope 8. A conductive film 10 is applied on the inner surface of the envelope 8 opposite to the grid 6 and cathodes 7 to prevent an external electric field from affecting the elements accomodated in the casing as well as to prevent the envelope from being electrically charged. The conductive film 10 may be electrically connected to the cathodes 7 or grid 6 or connected to the external terminals 11 through the leads 2*c* to apply a suitable potential between the cathodes and the anodes. The grid 6, cathodes 7 and transparent electrodes 2*a* are connected through the leads 2*c* of the transparent conductive film 2 to the external terminals 11.

In the fluorescent display device illustrated hereinabove, if the conductive film 10 is formed of light absorbing black conductive material, such as, for example, graphite, such a disadvantage can be effectively eliminated that light emitted from the phosphor layers 4 and directed to the envelope 8 is reflected by the conductive film 10 to irradiate non-luminous anode sections so as to reduce the contrast of luminous display of the light emitting anode sections, because the light is absorbed in the conductive film 10.

Figure 2:
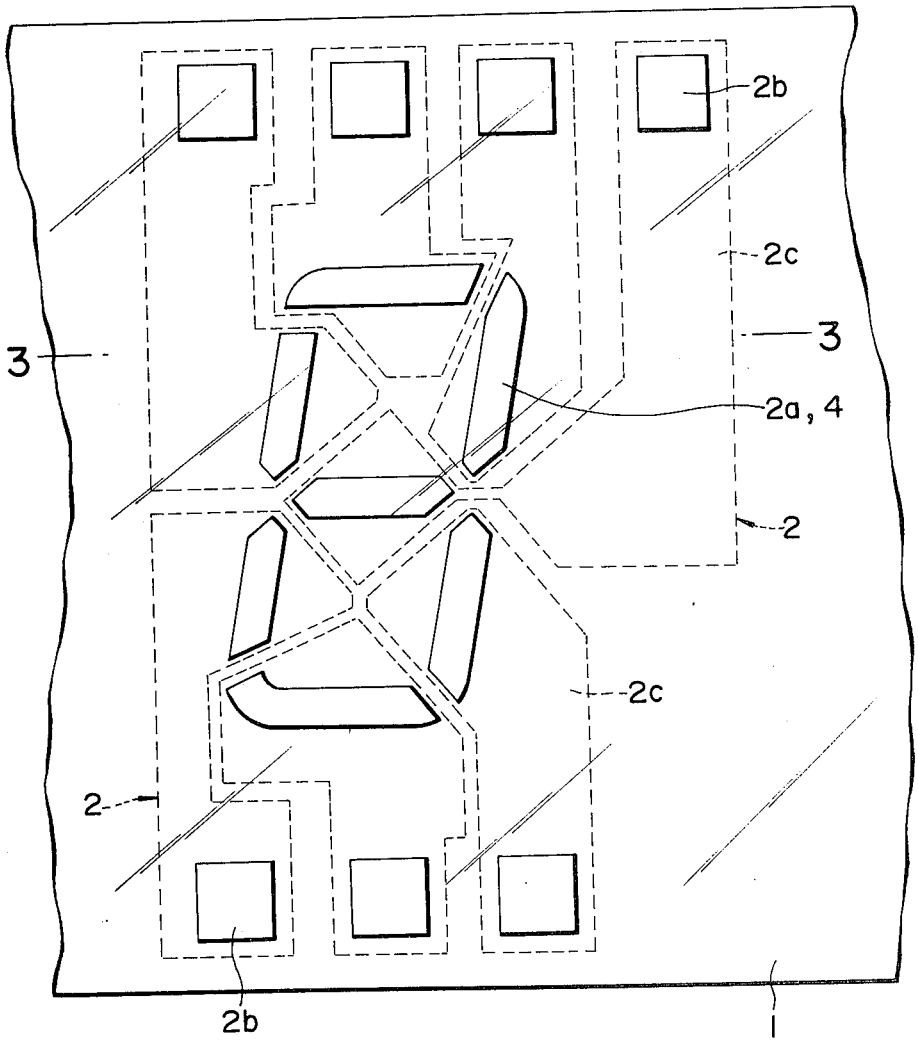
FIG. 2 is an enlarged fragmentary plan view of an anode section of a fluorescent display device according to an embodiment of the present invention.
Figure 3:
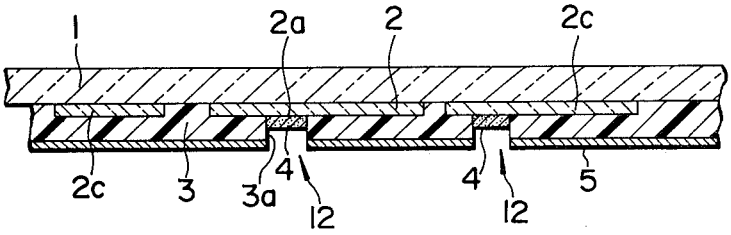
FIG. 3 is a sectional view taken along line III—III of FIG. 2.

The anode sections of the fluorescent display device may be constructed in such a manner as shown in FIGS. 2 and 3 although there are various ways for forming the anode sections on the substrate. FIGS. 2 and 3 illustrate a single digit display section in which an electrical connection between the anode sections and the external terminals 11 is made within the casing 9.

The manner of forming such electrical connection will be explained hereinafter with reference to FIGS. 2 and 3.

Firstly, the substrate 1 is provided with patterns of the transparent conductive films 2 which are divided into several fractions corresponding to the number of segments as indicated by dotted lines. The patterns are formed by applying the transparent conductive films 2 of $SnO_2$, $In_2O_3$ or a mixture of the materials on the overall surface of the substrate 1 and subsequently removing the unnecessary portions of the films 2 by photolithography. Alternatively, the transparent conductive films 2 may be applied directly on the substrate 1 by a vacuum evaporation using a mask to thereby form the predetermined patterns.

Then, the insulating layers 3 are formed on the patterns of the transparent conductive films except the portions acting as the transparent electrode sections 2*a* and terminal connecting sections 2*b*. The insulating layers 3 may be formed by applying material essentially consisting of, for example, frit glass having a low melting point on the films 2 utilizing a screen printing process and then calcining the material. A suitable pigment is preferably included in the material to render the resulting insulating layers 3 optically semitransparent or opaque. As far as the insulating layers 3 are not transparent, the color of the layers 3 is not essential. However, it is preferable to use a pigment having a color similar to the natural color or non-luminous color of the phosphor layers 4 which are to be applied in a subsequent step.

In the next step, the phosphor layers 4 are deposited on the transparent electrode sections 2*a* arranged in a segment shape which are not covered with the insulating layers 3. This step may be accomplished by utilizing a suitable method, such as, a screen printing method, a precipitation method, an electrodeposition method or the like. The phosphor layers 4 to be applied are preferably as thin as possible so that light emitted from the phosphor layers may be permeated therethrough without being significantly attenuated by the phosphor layers. However, it is a matter of course that the thickness should not be so thin that the phosphor layers 4 may effect ununiform luminous display. In addition, it is preferable to apply a silver paste on the terminal connectors 2*b*, which is, in turn, calcined to improve an electrical contact between the terminal connecting sections 2*b* and the external terminals 11. Then, the grid 6, cathodes 7 and envelope 8 are mounted in the conventional manner.

When the fluorescent display device assembled in the manner as explained hereinabove is connected to an outer power source, electrons emitted from the cathodes 7 impinge upon the phosphor layers 4 to allow the phosphor layers to produce a light emission. The light emitted from the phosphor layer 4 can be observed through the phosphor layers 4, transparent electrode sections 2*a* and substrate 1, while, the light emitted from the phosphor layers and directed to the grid 6 is absorbed in the conductive film 10 and insulating layers 3, and is prevented from coming through the non-luminous anode sections.

In the above embodiment, the leads 2c are formed of the transparent conductive films 2. However, the transparent conductive film generally has an electrical resistance several to several hundred times higher than that of a metal film. Therefore, when using the transparent conductive films 2 as the leads 2c in the fluorescent display device driven by a dynamic driving system, it causes significant voltage drops which result in irregularity in brightness between the segments or display patterns.

Figure 4:
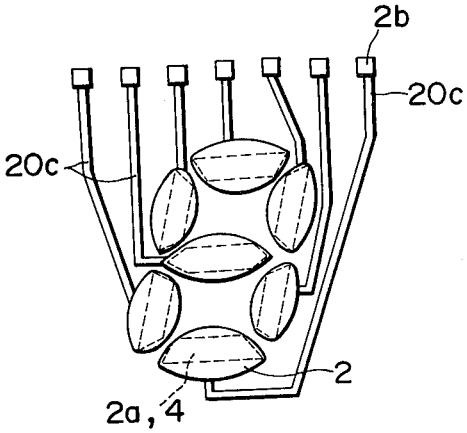
FIGS. 4, 5 and 6 are plan views of wiring patterns employed in fluorescent display devices according to second to fourth embodiments of the present invention.
Figure 5:
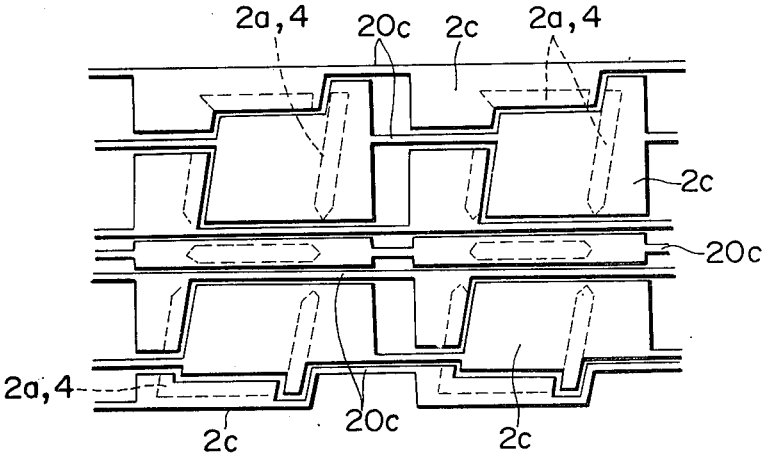
Figure 6:
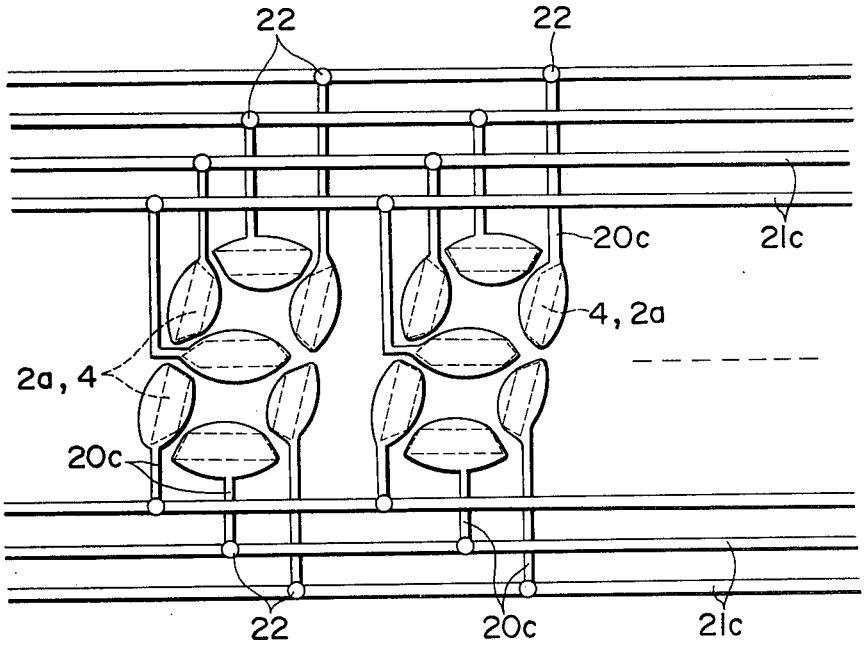

In order to eliminate such a disadvantage, the fluorescent display device may be formed as shown in FIGS. 4, 5 and 6 which illustrate second to fourth embodiments of the present invention. The fluorescent display device in the second to fourth embodiments is different only in wiring patterns of leads from that of the first embodiment. Therefore, the following explanations of these embodiments will be made with respect to the wiring patterns.

The wiring patterns of the second embodiment, as shown in FIG. 4, are formed in such a manner that metal films are deposited on a substrate which serve as leads 20c, and transparent electrode sections 2a having phosphor layers 4 deposited thereon and terminal connecting sections 2b are connected by means of the leads 20c.

The third embodiment shown in FIG. 5 concerns wiring patterns for use in the dynamic driving system in which each of transparent electrode sections 2a having phosphor layers 4 deposited thereon is formed to be wider as far as space permits and the enlarged portion of each electrode section 2a serves as a lead 2c. The lead 2c of each electrode section 2a is connected to the leads 2c of adjacent transparent electrode sections 2a which form the corresponding segment of the display pattern by means of narrow leads 20c of a metal film.

In the second and third embodiments explained hereinabove, it is preferable to make the leads 20c optically undiscriminating from the insulating layers 3 deposited thereon by mixing a pigment in materials for forming the leads 20 and the insulating layers to render both the leads 20 and the insulating layers similar color.

The fourth embodiment shown in FIG. 6 concerns wiring patterns suitable for use in the dynamic driving system as in the third embodiment. In this embodiment, each transparent electrode section 2a having a phosphor layer 4 deposited thereon is connected to a first lead 20c of a metal film, which is, in turn, connected to a second lead 21c of a metal film formed on an insulating film covering the first lead 20c by means of a through-hole 22. Each of the second leads 21c connects the respective transparent electrode sections 2a forming the adjacent corresponding segments of the display patterns as shown in FIG. 6.

The metal film used for the leads 20c in the second to fourth embodiments explained hereinabove is formed of, for instance, a silver paste which is applied to the substrate and is subsequently baked.

In the above embodiments, there are shown the fluorescent display devices which include the conductive films 5 deposited on the insulating layers 3. If there is not existed such conductive films, electrons emitted from the cathodes remain on the surfaces of the insulating layers 3 and the side wall portions of the concave areas 3a as shown in FIG. 7 to cause the insulating layers 3 around the anode sections to be negatively charged, because the phosphor layers 4 are thinner than the insulating layers 3.

Figure 7:
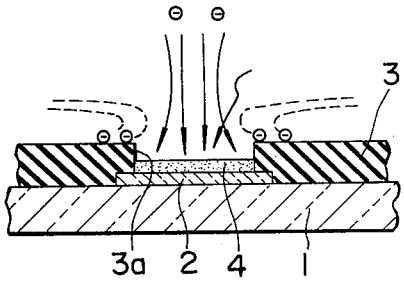
FIG. 7 is an enlarged sectional view of the essential part of a fluorescent display tube for explaining a problem of electric charge on an insulating layers.

The negative electric field created by the electrons remained on the insulating layers 3 deflects electrons subsequently emitted from the cathodes 7 as shown in FIG. 7, to thereby form areas at the peripheral portion of the anode sections where the electrons do not impinge. As a result, the luminous display is darkened, which makes the display hard to observe and deteriorates the display quality.

Figure 8:
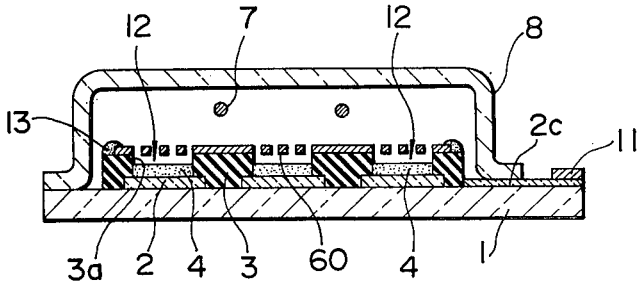
FIG. 8 is a longitudinal sectional view of a fluorescent display device according to a fifth embodiment of the present invention.

The fifth embodiment shown in FIG. 8 relates to a fluorescent display device which is constructed to reduce the manufacturing cost as well as to eliminate the above-mentioned disadvantage by disposing a control electrode 60 extending over concave areas 3a in the close or adjacent relationship to the upper surfaces of insulating layers 3 instead of providing the conductive film 5. The control electrode 60 may be secured on the insulating layers 3 by means of an adhesive 13. As shown in FIG. 8, the control electrode 60 includes a control section positioned above phosphor layers at the concave areas 3a to accelerate and control electrons emitted from cathodes with respect to the phosphor layers 4 and an antistatic section extending over the upper surface of the insulating layers 3 adjacent to the concave areas 3a to prevent the upper surface of the insulating layers from being negatively charged.

The control electrode means 60 may be formed of any suitable shape. The fluorescent display device of the present invention is not such a type that the luminous display of the phosphor layers 4 is observed through the control electrode. Therefore, it is not required to pay attention to optical permeability characteristics of the control electrode 60, but the control electrode 60 may be formed by taking electron control and acceleration capacities into consideration.

Figure 9:
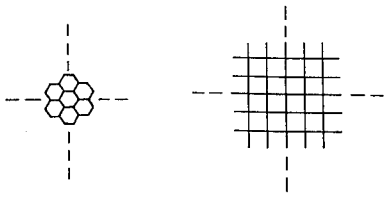
FIG. 9 is a plan view of an example of a control electrode suitable for use in the fifth embodiment of the present invention shown in FIG. 8.
Figure 10:
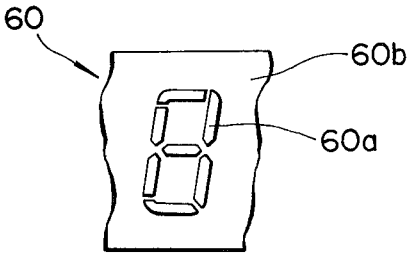
FIG. 10 is a plan view of another example of a control electrode suitable for use in the fifth embodiment of the present invention shown in FIG. 8.

The control electrode 60 may be of a rectangular or hexagonal reticular structure as shown in FIG. 9 which is to be disposed in the close relationship to the entire surfaces of the insulating layers 3 and the concave areas 3a. Alternatively, it may be constructed, as shown in FIG. 10, in such a manner that the control section 60a is formed of openings in the shape of a display pattern of the anode sections 12 which are arranged, for example, in the shape of the letter "8" and the antistatic section 60b is disposed around the control section 60a. In FIG. 10, the opening of the control section 60a may be of reticular structure.

It should be noted that the entire surfaces of the insulating layers 3 is not necessarily covered with the control electrode 60. Since the provision of the antistatic section is to prevent the surface of the insulating layers adjacent to the concave areas 3a from being negatively charged, it is sufficient to provide the antistatic section just around the concave areas 3a. The remaining structure of the fluorescent display device according to this embodiment is the substantially same as that of the embodiment of FIG. 1.

Figure 11:
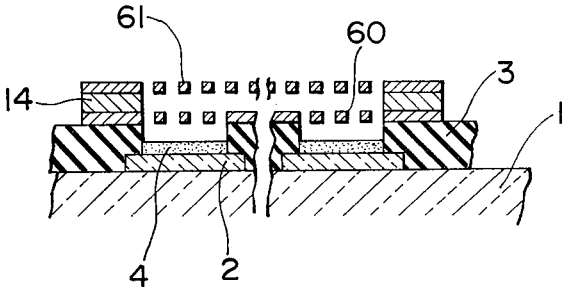
FIG. 11 is an enlarged sectional view of the essential portion of a fluorescent display device according to a sixth embodiment of the present invention.

The sixth embodiment of the present invention shown in FIG. 11 is to improve the permeance of a fluorescent display device. In this embodiment, a second control electrode 61 is disposed over a first electrode 60 by means of a spacer 14. This structure is effective to prevent the surface of the insulating layers 13 adjacent to anode sections 12 from being negatively charged by electrons, because the control electrode 60 extends to the surface of the insulating layers. Thus, electrons emitted from the cathodes 7 uniformly impinge upon the entire surface of phosphor layers 4 deposited on the anode sections without deflection of the electrons emitted from the cathodes 7 by the negative electric field resulting from the electric charge. As a result, the entire surface of the phosphor layers 4 gives forth emission, and the luminous display emitting the entire surface of the anode sections 12 uniformly can be observed through the phosphor layers 4, conductive films 2 and substrate 1.

In the above fifth and sixth embodiments, the control electrode is disposed to be contacted to the surfaces of the insulating layers 3. However, the control electrode 60 is not necessarily contacted to the insulating layers 3. For example, when the insulating layers 3 are thin and clearance between the surfaces of the insulating layers 3 and the surfaces of the phosphor layers 4 is extremely narrow, the control electrode 60 may be disposed above the insulating layers 3 by interposing extremely thin spacers between the insulating layers 3 and the control electrode 60, thereby to prevent the control electrode 60 from contacting to the phosphor layers 4. It is a matter of course that the control electrode may be formed to cover the surface of the insulating layers 3 adjacent to the concave areas 3*a* so as to prevent the surface portions from being negatively charged and to achieve uniform luminous display on the entire surfaces of the phosphor layers 4.

As explained hereinabove, in the fluorescent display device according to the present invention, the fluorescent display is observed through the surface of the transparent insulating substrate opposite to the other surface on which the functional elements for the display are mounted and the insulating layers are deposited on the surface of the substrate except the portions having the phosphor layers deposited thereon. Therefore, the display device of the present invention can exhibit clear and bright luminous display. When the insulating layers are formed of semitransparent or opaque material, the display device can increase in the contrast of the luminescent segments with respect to the circumferential elements, which makes it possible to effect clear display, because the functional elements within the envelope, such as, the grids are not visible from the outside. In the fluorescent display device of the present invention, if the insulating layers are formed of material of the same or similar color to the phosphor layers, the contrast between the luminous segments and the non-luminous segments can be increased, and the clear display can be effected. According to the fluorescent display device of the present invention, the internal functional elements are invisible from the outside. Thus, the provision of a filter for visually covering the internal structure and decreasing in the brightness of the display can be eliminated. In addition, any suitable support means can be used for reinforcing the evacuated envelope as long as it does not deteriorate the electrical properties of the device, because the internal structure of the fluorescent display device is invisible from the outside. Therefore, a large-size fluorescent display device can be manufactured at a low cost.

In the fluroescent display device of the present invention, when each of the transparent electrodes are connected by leads which are superior in conductivity to the transparent electrodes, it is possible to effect the luminous display giving force uniform emission even in the dynamic driving system.

Furthermore, the fluorescent display device of the present invention can be constructed so as to include the thin phosphor layers and the control electrode which extends to the surface of the insulating layers adjacent to the phosphor layers and is supported on or adjacent to the surface portions. Therefore, it is possible to prevent the surface portions from being negatively charged and to allow electrons emitted from the cathodes to uniformly impinge upon the entire surfaces of the phosphor layers. Thus, the phosphor layers give force uniform emission from the entire surfaces thereof, and exhibit the luminous display of excellent quality.

Furthermore, the fluorescent display device of the present invention includes phosphor layers deposited on the conductive films 2 which are thinner than that of the insulating layers. Therefore, light emitted from the phosphor layers is hardly attenuated by the phosphor layers, which makes it possible to effect the luminous diaplay of sufficient brightness.

In the present invention, if the control electrode is closely disposed on the insulating layers, an additional member such as a spacer for mounting the control electrode with respect to the insulating layers can be eliminated, and the assembling operation of the fluorescent display device can be remarkably simplified.

Obviously, many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. A fluorescent display device comprising:

a transparent insulating substrate defining a pair of opposed surfaces;

transparent anode sections made of transparent conductive films applied on one surface of said transparent substrate and having phosphor layers deposited thereon;

wiring means formed on said one surface of said transparent substrate for applying display signals to said anode sections;

cathodes mounted above said anode sections for emitting electrons impinging upon said anode sections to allow said phosphor layers to produce light emission of a predetermined shape in response to said display signal;

insulating layers deposited on said transparent conductive films except said anode sections on which said phosphor layers are deposited;

control electrode means disposed between said cathodes and said anode sections for controlling and accelerating said electrons to allow said electrons to uniformly impinge upon the entire surfaces of said phosphor layers;

a cover mounted on said substrate and in sealing relationship therewith, wherein the space between said substrate and said cover is evacuated to provide a sealed, evacuated envelope;

said phosphor layers having a thickness less than said insulating layers; and said control electrode means having anti-static conductive portions extending to at least the surface portions of said insulating layers adjacent to and around each of said phosphor layers in the close or adjacent relationship to said surface portions, whereby said luminous display produced by said phosphor layers is observed through the other surface of said transparent substrate.

2. A fluorescent display device as defined in claim 1, wherein said insulating layers are semitransparent or opaque.

3. A fluorescent display device as defined in claim 1, wherein said insulating layers have a color similar to that of said phosphor layers.

4. A fluorescent display device as defined in claim 1 or 2, wherein at least one part of said wiring means comprises leads formed of the same kind of material as that of said transparent anode sections.

5. A fluorescent display device as defined in claim 1 or 2, wherein said wiring means comprises leads formed of material different from that of forming said transparent anode sections.

6. A fluorescent display device as defined in claim 1, wherein said control electrode means includes a first control electrode closely disposed on said insulating layers and a second control electrode overlapped on said first control electrode through a spacer means.

7. A fluorescent display device as defined in claim 1, further comprising:

a non-reflective conductive layer formed on a surface of said cover within said evacuated envelope.

* * * * *